US005333042A

United States Patent [19]

Brennan et al.

[11] Patent Number: 5,333,042

[45] Date of Patent: Jul. 26, 1994

[54] COLD FUSING AGENT

[75] Inventors: Michael W. Brennan, Oak Park; Frank J. LaChapelle, Bell Caynon, both of Calif.

[73] Assignee: Interscience Computer Corporation, Agoura Hills, Calif.

[21] Appl. No.: 990,134

[22] Filed: Dec. 14, 1992

[51] Int. Cl.[5] ..... G03G 15/20

[52] U.S. Cl. ..... 355/292; 430/124

[58] Field of Search ..... 355/292; 430/124; 427/335; 34/148, 151, 155

[56] References Cited

U.S. PATENT DOCUMENTS

| | | | |
|---|---|---|---|
| 2,726,166 | 12/1955 | Greaves | 430/124 |
| 3,117,847 | 1/1964 | Norton | 355/292 |
| 3,383,775 | 5/1968 | Jacob et al. | 427/335 X |
| 3,950,168 | 4/1976 | Erhardt et al. | 430/124 X |
| 4,264,304 | 4/1981 | Hausmann | 34/155 X |
| 4,311,723 | 1/1982 | Mugrauer | 427/335 X |
| 4,388,396 | 6/1983 | Nishibayashi | 430/126 |
| 4,503,625 | 3/1985 | Manzer | 34/78 |
| 4,726,293 | 2/1988 | Ende | 101/228 |
| 4,920,881 | 5/1990 | Tafel | 101/488 |
| 5,014,090 | 5/1991 | Santilli | 355/256 |
| 5,017,416 | 5/1991 | Imperial et al. | 428/195 |

FOREIGN PATENT DOCUMENTS

| | | | |
|---|---|---|---|
| 0465037 | 1/1992 | European Pat. Off. . | |
| 0005395 | 2/1971 | Japan | 430/124 |
| 0031327 | 8/1974 | Japan | 430/124 |
| 0839989 | 6/1960 | United Kingdom . | |
| 2029325 | 3/1980 | United Kingdom . | |
| 2121356 | 12/1983 | United Kingdom . | |
| 2125736 | 3/1984 | United Kingdom . | |

OTHER PUBLICATIONS

Genetron 141b—Storage and Handling, Allied Signal Inc. Publication, 1990.

*Primary Examiner*—R. L. Moses
*Assistant Examiner*—Robert Beatty
*Attorney, Agent, or Firm*—Lyon & Lyon

[57] ABSTRACT

A method for cold fusion printing of characters. The method employs a hydrochlorofluorocarbon fusing agent within a cold fusion printing process to provide superior characteristics. Prior to fusion, toner is temporarily held to the surface of paper by the difference in electrostatic charge between the toner and the paper. Vapors of the hydrochlorofluorocarbon fusing agent are directed to the toner and act on the toner so as to permanently affix the toner to the paper, more rapidly than in known hot fusion methods and with fewer adverse environmental consequences than result from known cold fusion methods.

9 Claims, 2 Drawing Sheets

COLD FUSING AGENT

FIELD OF THE INVENTION

The invention generally relates to a method of fusing toner to paper, and more particularly, to a method of cold fusion which employs a hydrochlorofluorocarbon fusing agent.

BACKGROUND OF THE INVENTION

The conventional hot fusion laser printing process consists of the three basic steps of character generation, character transfer, and character fusion.

Character fusion, within the hot fusion laser printing process, creates a permanent image on the paper by means of a heat fusing station. The heat fusing station operates by transporting paper past a heat plate and then through a heated roller assembly. The heated roller assembly typically presses a free dyed-black plastic powder, called toner, into the paper and permanently fuses them into place by heat. Toner is ordinarily composed of styrene/acrylate polymer, polyvinyl butyryl resin and carbon black.

In contrast to the conventional hot fusion laser printing process, a cold fusion printing process has been developed. Cold fusion printing processes can, however, achieve significantly higher printing speeds in comparison to conventional hot fusion laser printers.

A significant distinction between a hot fusion printing process and a cold fusion printing process lies within the character fusion step. The cold fusion process creates a vapor bath from a fusing agent. The fusing agent then liquifies the toner which is, in ram, absorbed by the paper.

Current cold fusion processes utilize an azeotropic blend of freon and acetone as a fusing agent. Despite the commercial success of the cold fusion printing process, the employment of an azeotropic blend of freon and acetone as a fusing agent has been unsatisfactory. Specifically, the employment of an azeotropic blend of freon and acetone as a fusing agent has led to inferior bonding characteristics and solvent properties. Furthermore, azeotropic blends of freon and acetone present environmental hazards, high costs, a minimal yield, and are in scarce supply.

SUMMARY OF THE INVENTION

The present invention overcomes the aforementioned deficiencies of the prior art by providing a method employing a fusing agent with superior characteristics.

The present invention consists of the employment of a hydrochlorofluorocarbon as a fusing agent within a cold fusion printing process. Hydrochlorofluorocarbons have demonstrated superior bonding characteristics and solvent properties in comparison to other fusing agents. Furthermore, when used with a properly adjusted laser printer, it is appreciably more efficient and environmentally safe than other fusing agents.

DETAILED DESCRIPTION OF A PREFERRED EMBODIMENT OF THE INVENTION

In accordance with a preferred embodiment of the invention, a cold fusion printing process may be implemented within the Siemens Nixdorf Model 2220 Laser Printing System. Such a printing system is disclosed in: Siemens 2200 Operator Training Manual (1985); Siemens Printing System, 2200 Model 2, Operating Manual (December 1984); Siemens Laser Printer ND3 RFC, Maintenance Manual (1987); Siemens Laser Printer ND3C/2200, Parts Catalog (1987); and 6100 Student Guide, STC Canada, Inc. (1985), all of which are incorporated herein by reference.

Figure 1:
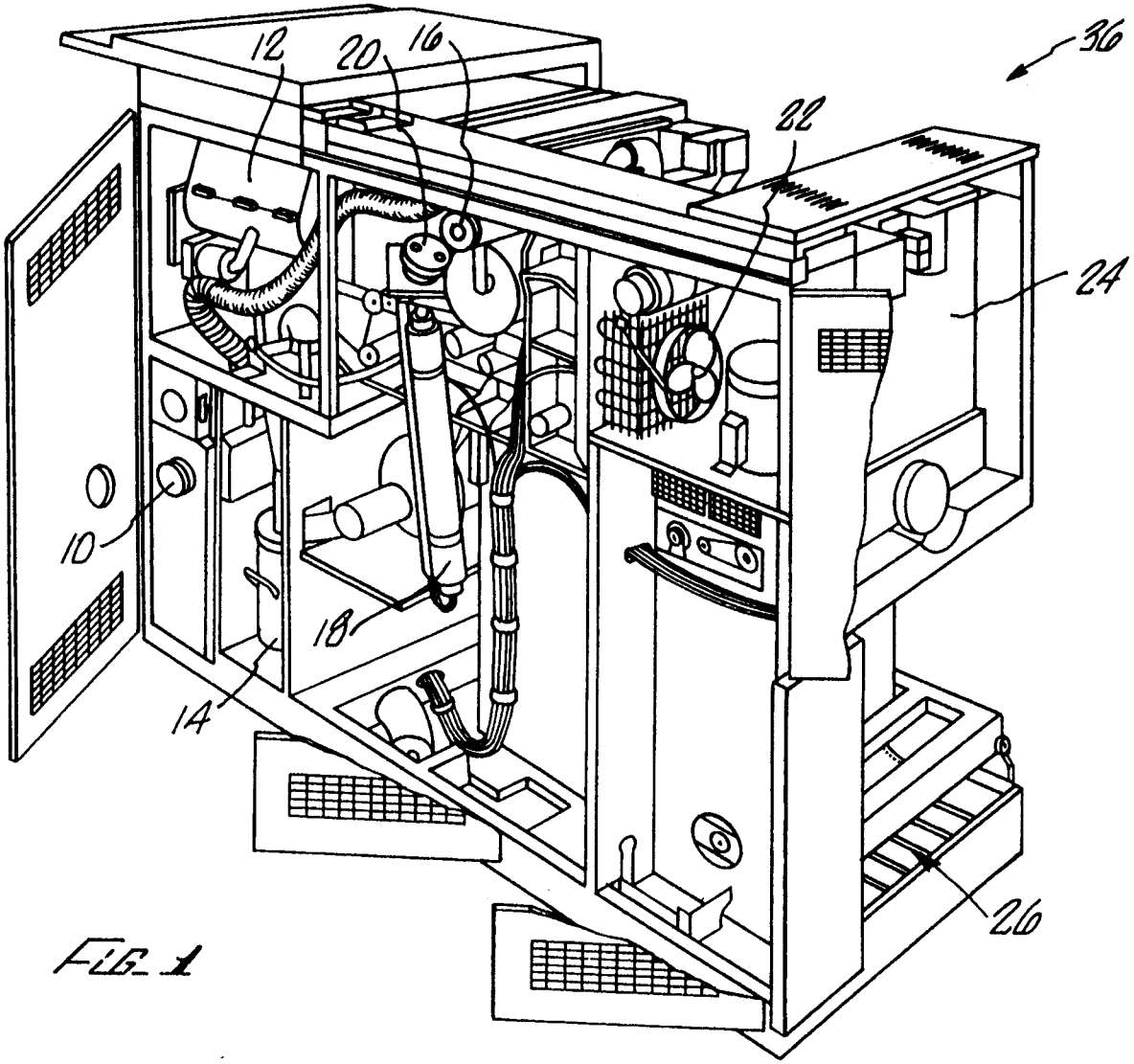
FIG. 1 illustrates an example of an apparatus employing a cold fusion printing process.

Referring to FIG. 1, a Siemens Nixdorf Model 2200 Laser Printing System is generally illustrated. The cold fusion printing system 36 possesses a main power switch 10, a toner reservoir 12, a toner collection container 14, a main motor 16, a laser 18, a laser optics assembly 20, a cooling assembly 22, a cold fusing station 24, and a forms stacker 26.

Figure 2:
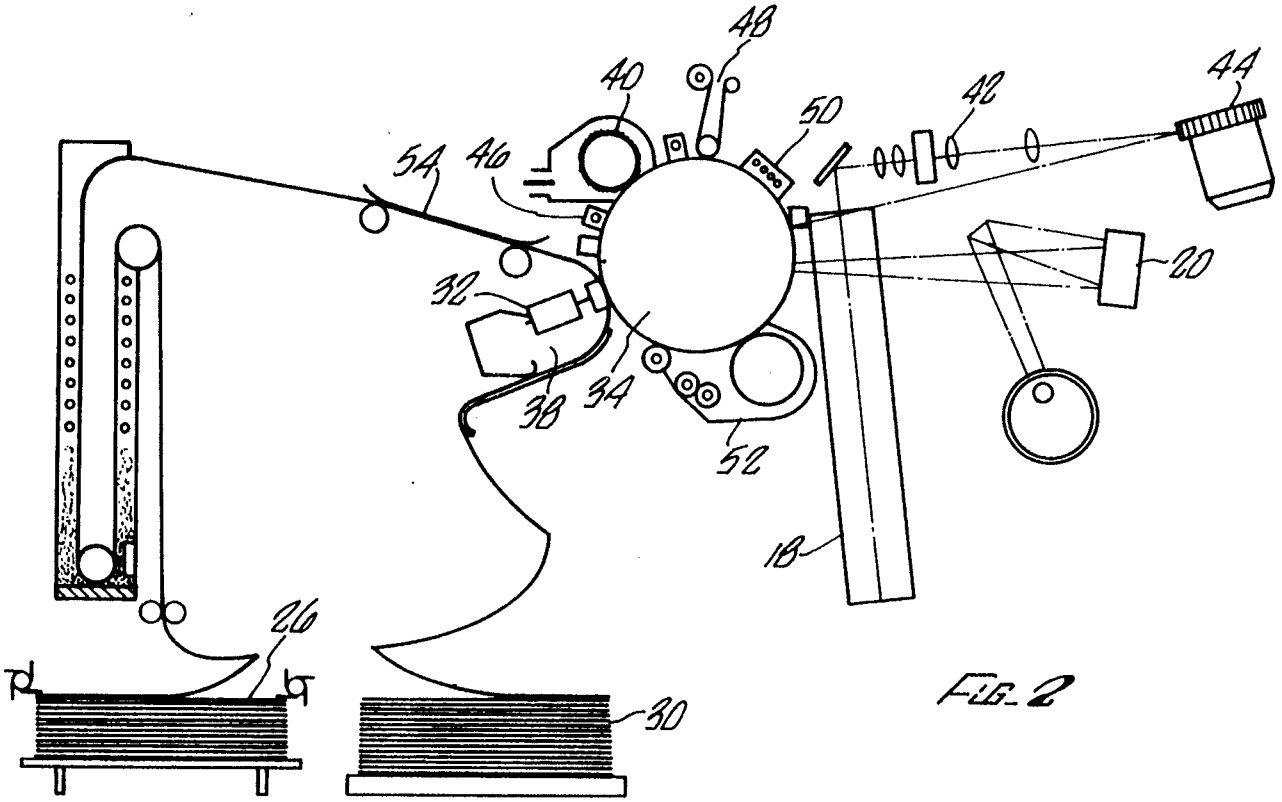
FIG. 2 illustrates a cross-sectional view of a cold fusion printing system.

Referring to FIG. 2, a cross-sectional view of the aforementioned cold fusion printing system 36 in which the present invention is to be implemented is illustrated. The printing system 36 undertakes three basic steps to produce printed matter on paper. These three steps are character generation, character transfer, and cold fusion of characters.

The printing system 36 begins the printing process after retrieving a blank sheet of paper from the forms input tray 30, and transferring the paper to an input station 38. The input station 38 leads the paper to a position adjacent to a photo-conductive drum 34. While the present invention is described using a paper medium, other suitable mediums may also be employed with satisfactory results.

Character generation is achieved by forming characters on a photo-sensitive drum 34. Initially the surface of a rotating photo-sensitive drum 34 is charged to a positive polarity by means of a charge corotron 50. Subsequently, the laser 18, in conjunction with an acousto-optical deflection system 42, a polygon mirror 44 and the laser optics assembly 20, selectively forms characters upon selected portions of the surface of drum 34 by erasing the charge in image (character) areas. Thus, only the areas occupied by laser generated characters have a neutral polarity upon the drum 34, and the remaining area of this drum 34 remains positively polarized.

Continuous rows of dots are formed on the rotating drum 34 creating a representation of the character to be printed. As will be appreciated by one skilled in the art, "character" as used in this context refers to any graphic figure, expression, representation, or any part thereof which is generated on the polarized drum. The drum 34 is rotated past a developer station 52 which contains a fine dyed-black plastic powder, generally referred to as toner. The toner is positively charged and applied across the width of the rotating drum 34 by the developer station 52. The toner, possessing a positive charge, is repelled into the erased areas of the drum 34 to represent the character that will be printed. This process is well known to the art. See Mugrauer, U.S. Pat. No. 4,311,723 which is incorporated herein by reference.

Character transfer occurs as the paper, which is energized with a very strong negative charge, rotates past the transfer station 32. The transfer is accomplished since the differential between the charged paper and the toner is of such a significant differential that the toner is attracted from the surface of the drum 34 to the paper. The toner is held to the paper only by the charge difference, and at this stage could be blown or brushed off the paper. As will be explained in more detail below, a cold fusion step is subsequently performed to cause the toner to adhere more securely to the paper medium.

The drum 34 is then rotated past a discharging corotron 46 which discharges the positively polarized areas of the drum 34. Thereafter, a cleaning brush 40 and cleaning fleece 48 remove excess toner for recycling as well as electrically clean the drum 34. Subsequently, the charge corotron 50 electrostatically charges the surface of the drum with a positive charge. The aforementioned steps are then repeated for a subsequent printing.

Upon completion of character transfer, the paper is transported by means of a paper transport mechanism 54 to the cold fusing station 24. The process of fusing the toner to the paper is accomplished by two steps within the cold fusion station: (i) a vapor bath and (ii) cold fusion of the characters.

Figure 3:
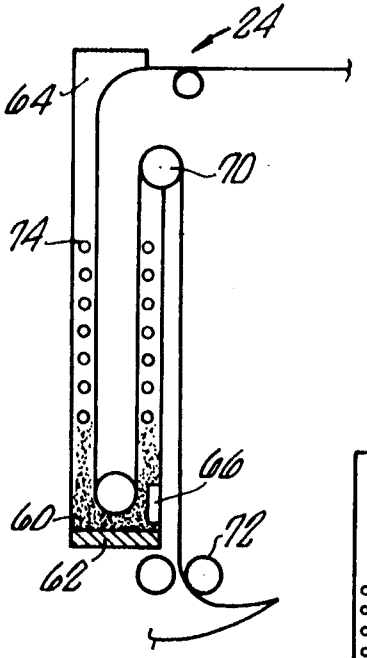
FIG. 3 illustrates a cross-sectional view of a cold fusing station.

Referring to FIG. 3, a cross-sectional view of the cold fusing station 24 is illustrated. A vapor bath is created by confining vapors of a hydrochlorofluorocarbon fusing agent 60. An especially preferred embodiment employs 1,1-dichloro-1-fluoroethane (known in the art as HCFC-141b) as the fusing agent. The HCFC-141b fusing agent is commercially available from Interscience Computer Corporation, Agoura Hills, Calif., under the trade name BONDEX-22 TM.

A vapor cloud is then generated by a thermo-resistively controlled hot plate 62, which takes advantage of a low boiling point of the fusing agent. The vapor cloud is generally confined in a fusing chamber 64 by a chilled air interface that is developed by a set of condensing coils 74 which are located near the top of the fusing station. The density of the vapor cloud is controlled by measuring the impenetrability of the cloud by an ultrasonic sensor 66. The fusing agent 60 is then introduced, dependent on the measured density of the cloud, into the system by droplets that are emitted onto the surface of the hot plate 62. The droplets of fusing agent are, in turn, vaporized to increase the density of the confined cloud.

Cold fusion of the characters is produced by transporting the paper through the solvent vapor cloud. The solvicity characteristics of the fusing agent 60 liquifies the toner which is then absorbed by the paper. The evaporation rate of the fusing agent 60 insures that the toner is fixed to the paper.

Finally, the paper exits the cold fusion chamber 64 by means of the deflection roller 70. Thereafter, it passes through a set of exit rolls 72 and onto the forms stacker 26.

A more preferred embodiment employs an azeotropic blend of 1,1-dichloro-1-fluoroethane with nitromethane and methanol as a fusing agent. U.S. Pat. No. 4,816,174 further discloses such a suitable azeotropic blend of 1,1-dichloro-1-fluoroethane with nitromethane and methanol. U.S. Pat. No. 4,816,174, entitled "AZEOTROPE-LIKE COMPOSITIONS OF 1,1-DICHLORO-1-FLUOROETHANE, METHANOL AND NITROMETHANE," is incorporated herein by reference. The fusing agent of HCFC-141b, in combination with nitromethane and methanol, is also commercially available from Interscience Computer Corporation, Agoura Hills, Calif., under the trade name BONDEX-22 TM. Such azeotropic fusing agent is composed of 96.0 weight percent 1,1-dichloro-1-fluoroethane, 3.9 weight percent methanol, and 0.1 weight percent nitromethane.

Further preferred examples may employ other azeotropic-like compositions of 1,1-dichloro-1-fluoroethane. Such compositions may include 1,1-dichloro-1-fluoroethane in combination with: methyl formate and methanol as disclosed by U.S. Pat. No. 5,152,913; tetrafluoroethane as disclosed by U.S. Pat. No. 5,145,606; dichlorotrifluoroethane, nitromethane, and methanol or alcohol as disclosed by U.S. Pat. No. 5,145,598; dichlorofluoroethane, 1,2-dichloroethylene, and optionally methanol or ethanol as disclosed by U.S. Pat. No. 5,137,651; stabilizing additives or inhibitors, such as alpha-pinene oxide, as disclosed by U.S. Pat. No. 5,135,680; 1,2-dichloroethylene and optionally an alkanol as dislosed by U.S. Pat. No. 5,126,067; dichlorotrifluoroethane, ethanol and an alkane having 5 or 6 carbon atoms as disclosed by U.S. Pat. No. 5,124,064; dichlorotrifluoroethane, methanol and an alkane having 5 or 6 carbon atoms as disclosed by U.S. Pat. No. 5,124,063; dichlorotrifluoroethane, ethanol, and an alkene having 5 carbon atoms as disclosed by U.S. Pat. No. 5,122,294; chloropentafluoropropane as disclosed by U.S. Pat. No. 5,120,470; dichlorotrifluoroethane, methanol and an alkene having 5 carbon atoms as disclosed by U.S. Pat. No. 5,120,461; 1,2-dichloro-1-fluoroethane as disclosed by U.S. Pat. No. 5,114,609; 2-methylbutane as disclosed by U.S. Pat. No. 5,106,527; 2-methylbutane as disclosed by U.S. Pat. No. 5,102,920; cyclopentane and optionally an alkanol as disclosed by U.S. Pat. No. 5,085,798; a monochlorinated C3 alkane and optionally an alkanol as disclosed by U.S. Pat. No. 5,085,797; dichlorotrifluoroethane, ethanol and a monochlorinated or di-chlorinated C2 or C3 alkane as disclosed by U.S. Pat. No. 5,085,796; methanol and nitromethane as disclosed by U.S. Pat. No. 5,073,206; dichlorotrifluoroethane and methyl formate as disclosed by U.S. Pat. No. 5,049,301; dichloromethane and optionally an alkanol as disclosed by U.S. Pat. No. 5,039,442; n-perfluorobutylethylene as disclosed by U.S. Pat. No. 5,037,573; dichlorotrifluoroethane, and alkane or cycloalkane having 5 carbon atoms as disclosed by U.S. Pat. No. 5,026,502; dichlorotrifluoroethane and dichloromethane as disclosed by U.S. Pat. No. 5,026,501; perfluoro-1,2-dimethylcyclobutane, with methanol or dichlorotrifluoroethane as disclosed by U.S. Pat. No. 5,026,497; dichlorotrifluoroethane, methanol and a mono-chlorianted or di-chlorinated C2 or C3 alkane as disclosed by U.S. Pat. No. 5,024,781; perfluoro-1,2-dimethylcyclobutane or dichlorotrifluoroethane as disclosed by U.S. Pat. No. 4,994,202; dichlorotrifluoroethane, methanol and cyclopentane as disclosed by U.S. Pat. No. 4,994,201; dichlorotrifluoroethane, and nitromethane as disclosed by U.S. Pat. No. 4,965,011; dichlorotrifluoroethane, and a monochlorinated or di-chlorinated C2 or C3 alkane as disclosed by U.S. Pat. No. 4,960,535; dichlorotrifluoroethane and methanol as disclosed by U.S. Pat. No. 4,894,176; dichlorotrifluoroethane and ethanol as disclosed by U.S. Pat. No. 4,863,630; methanol as disclosed by U.S. Pat. No. 4,842,764; and ethanol as disclosed by U.S. Pat. No. 4,836,947.

Suitable cold fusion agents may include agents, and mixtures thereof, which are disclosed in the following U.S. patents, the entire disclosure of which, are incorporated herein by reference: U.S. Pat. No.: 5,152,913 entitled "CLEANING COMPOSITION BASED ON 1,1-DICHLORO-1-FLUOROETHANE, METHYL FORMATE AND METHANOL"; U.S. Pat. No. 5,145,606 entitled "BLOWING COMPOSITIONS"; U.S. Pat. No. 5,145,598 entitled "AZEOTROPE-LIKE COMPOSITIONS OF 1,1-DICHLORO-1-FLUOROETHANE, DICHLOROTRIFLUOROETHANE, NITROMETHANE AND METHANOL OR ETHANOL"; U.S. Pat. No. 5,137,651 entitled "AZEOTROPE-LIKE COMPOSITIONS OF 1,1-DICHLORO-1-FLUOROETHANE, DICHLOROTRIFLUOROETHANE, 1,2-DICHLOROETHYLENE, AND OPTIONALLY METHANOL 0R ETHANOL"; U.S. Pat. No. 5,135,680 entitled "STABILIZED 141b"; U.S. Pat. No. 5,126,067 entitled "AZEOTROPE-LIKE COMPOSITIONS OF 1,1-DICHLORO-1-FLUOROETHANE, 1,2-DICHLOROETHYLENE AND OPTIONALLY AN ALKANOL"; U.S. Pat. No. 5,124,064 entitled "AZEOTROPE-LIKE COMPOSITIONS OF 1,1-DICHLORO-1-FLUOROETHANE; DICHLOROTRIFLUOROETHANE; ETHANOL; AND ALKANE HAVING 5 OR 6 CARBON ATOMS"; U.S. Pat. No. 5,124,063 entitled "AZEOTROPE-LIKE COMPOSITIONS OF 1,1-DICHLORO-1-FLUOROETHANE; DICHLOROTRIFLUOROETHANE; METHANOL; AND ALKANE HAVING 5 OR 6 CARBON ATOMS"; U.S. Pat. No. 5,122,294 entitled "AZEOTROPE-LIKE COMPOSITIONS OF 1,1-DICHLORO-1-FLUOROETHANE; DICHLOROTRIFLUOROETHANE; ETHANOL; AND ALKENE HAVING 5 CARBON ATOMS"; U.S. Pat. No. 5,120,470 entitled "SOLVENT COMPOSITION COMPRISING A CHLOROPENTAFLUOROPROPANE AND A CHLOROFLUOROETHANE"; U.S. Pat. No. 5,120,461 entitled "AZEOTROPE-LIKE COMPOSITIONS OF 1,1-DICHLORO-1-FLUOROETHANE; DICHLOROTRIFLUOROETHANE; METHANOL; AND ALKENE HAVING 5 CARBON ATOMS"; U.S. Pat. No. 5,114,609 entitled "CLEANING COMPOSITIONS"; U.S. Pat. No. 5,106,527 entitled "AZEOTROPES OF 2-METHYLBUTANE AND 1,1-DICHLORO-1-FLUOROETHANE AND THE USE THEREOF IN THE PRODUCTION OF RIGID FOAMS"; U.S. Pat. No. 5,102,920 entitled "NOVEL AZEOTROPES AND THE USE THEREOF IN THE PRODUCTION OF RIGID FOAMS"; U.S. Pat. No. 5,085,798 entitled "AZEOTROPE-LIKE COMPOSITIONS OF 1,1-DICHLORO-1-FLUOROETHANE, CYCLOPENTANE AND OPTIONALLY AN ALKANOL"; U.S. Pat. No. 5,085,797 entitled "AZEOTROPE-LIKE COMPOSITIONS OF 1,1-DICHLORO-1-FLUOROETHANE, A MONOCHLORINATED C3 ALKANE AND OPTIONALLY AN ALKANOL"; U.S. Pat. No. 5,085,796 entitled "AZEOTROPE-LIKE COMPOSITIONS OF 1,1-DICHLORO-1-FLUOROETHANE, DICHLOROTRIFLUOROETHANE, ETHANOL AND A MONO- OR DI-CHLORINATED C2 OR C3 ALKANE"; U.S. Pat. No. 5,073,206 entitled "METHOD OF CLEANING USING AZEOTROPE-LIKE COMPOSITIONS OF 1,1-DICHLORO- 1-FLUOROETHANE, METHANOL AND NITROMETHANE"; U.S. Pat. No. 5,049,301 entitled "AZEOTROPE-LIKE COMPOSITIONS OF 1,1-DICHLORO-1-FLUOROETHANE; DICHLOROTRIFLUOROETHANE; AND METHYL FORMATE"; U.S. Pat. No. 5,039,442 entitled "AZEOTROPE-LIKE COMPOSITIONS OF 1,1-DICHLORO-1-FLUOROETHANE, DICHLOROMETHANE AND OPTIONALLY ALKANOL"; U.S. Pat. No. 5,037,573 entitled "BINARY AZEOTROPIC COMPOSITIONS OF 1,1-DICHLORO-1-FLUOROETHANE AND N-PERFLUOROBUTYLETHYLENE"; U.S. Pat. No. 5,026,502 entitled "AZEOTROPE-LIKE COMPOSITIONS OF 1,1-DICHLORO-1-FLUOROETHANE; DICHLOROTRIFLUOROETHANE; AND ALKANE 0R CYCLOALKANE HAVING 5 CARBON ATOMS"; U.S. Pat. No. 5,026,501 entitled "AZEOTROPE-LIKE COMPOSITIONS OF 1,1-DICHLORO-1-FLUOROETHANE; DICHLOROTRIFLUOROETHANE; AND DICHLOROMETHANE"; U.S. Pat. No. 5,026,497 entitled "AZEOTROPIC COMPOSITIONS OF PERFLUORO-1,2-DIMETHYLCYCLOBUTANE WITH METHANOL AND 1,1-DICHLORO-1-FLUOROETHANE OR DICHLOROTRIFLUOROETHANE"; U.S. Pat. No. 5,024,781 entitled "AZEOTROPIC-LIKE COMPOSITIONS OF 1,1-DICHLORO-1-FLUOROETHANE, DICHLOROTRIFLUOROETHANE, METHANOL AND A MONO- OR DICHLORINATED C2 OR C3 ALKANE"; U.S. Pat. No. 4,994,202 entitled "AZEOTROPIC COMPOSITIONS OF PERFLUORO-1,2-DIMETHYLCYCLOBUTANE WITH 1,1-DICHLORO-1-FLUOROETHANE 0R DICHLOROTRIFLUOROETHANE"; U.S. Pat. No. 4,994,201 entitled "AZETROPE-LIKE COMPOSITIONS OF 1,1-DICHLORO-1-FLUOROETHANE, DICHLOROTRIFLUOROETHANE, METHANOL AND CYCLOPENTANE"; U.S. Pat. No. 4,965,011 entitled "AZEOTROPE-LIKE COMPOSITIONS OF 1,1-DICHLORO-1-FLUOROETHANE, DICHLOROTRIFLUOROETHANE, AND NITROMETHANE"; U.S. Pat. No. 4,960,535 entitled "AZEOTROPE-LIKE COMPOSITIONS OF 1,1-DICHLORO-1-FLUOROETHANE, DICHLOROTRIFLUOROETHANE AND A MONO- OR DICHLORINATED C2 OR C3 ALKANE"; U.S. Pat. No. 4,894,176 entitled "AZEOTROPE-LIKE COMPOSITIONS OF 1,1-DICHLORO-1-FLUOROETHANE, DICHLOROTRIFLUOROETHANE AND METHANOL"; U.S. Pat. No. 4,863,630 entitled "AZEOTROPE-LIKE COMPOSITIONS OF 1,1-DICHLORO-1-FLUOROETHANE, DICHLOROTRIFLUOROETHANE AND ETHANOL"; U.S. Pat. No. 4,842,764 entitled "AZEOTROPE-LIKE COMPOSITIONS OF 1,1-DICHLORO-1-FLUOROETHANE AND METHANOL"; and U.S. Pat. No. 4,836,947 entitled "AZEOTROPE-LIKE COMPOSITIONS OF 1,1-DICHLORO-1-FLUOROETHANE AND ETHANOL".

While the present invention has been described in connection with the presently preferred embodiment, it will be apparent to those skilled in the art, after having the benefit of the disclosure set forth herein, that modifications may be made, additional steps may be performed, additional chemicals or other agents may be added, and improvements may be incorporated without departing from the spirit and scope of the present inventions. The present invention is not limited to the specific example described herein, but is only limited by the scope of the claims set forth below.

We claim:

1. A method for cold fusion of a toner to a medium utilizing a fusing agent, comprising the steps of:
(a) generating representations of characters by transferring toner to selected areas of the medium;
(b) forming a vapor cloud of hydrochlorofluorocarbon as the sole fusing agent; and
(c) transporting the medium through the vapor cloud to fuse the toner to the medium.

2. A method for cold fusion of a toner to a medium utilizing a fusing agent, comprising the steps of:
(a) forming electrostatic representations of characters having a first polarity on a photo-sensitive drum having a second polarity;
(b) applying toner having said second polarity to the photo-sensitive drum;
(c) transferring said characters from the photo-sensitive drum to the medium;
(d) forming a vapor cloud of hydrochlorofluorocarbon as the sole fusing agent; and
(e) transporting the medium through the vapor cloud to fuse the toner to the medium.

3. A method for cold fusion of a toner to a medium utilizing a fusing agent, comprising the steps of:
(a) generating representations of characters by transferring toner to selected areas of the medium;
(b) forming a vapor cloud of 1,1-dichloro-1-fluoroethane as the sole fusing agent; and
(c) transporting the medium through the vapor cloud to fuse the toner to the medium.

4. A method for cold fusion of a toner to a medium utilizing a fusing agent, comprising the steps of:
(a) forming electrostatic representations of characters having a first polarity on a photo-sensitive drum having a second polarity;
(b) applying toner having said second polarity to the photo-sensitive drum;
(c) transferring said characters from the photo-sensitive drum to the medium;
(d) forming a vapor cloud of 1,1-dichloro-1-fluoroethane as the sole fusing agent; and
(e) transporting the medium through the vapor cloud to fuse the toner to the medium.

5. The method for cold fusion of a toner to a medium utilizing a fusing agent according to any of claims 1, 2, 3, or 4 wherein the medium is paper.

6. The method for cold fusion of a toner to a medium utilizing a fusing agent according to claim 1, further comprising the step of selecting a substantially 100% hydrochlorofluorocarbon compound from which to form the vapor cloud.

7. The method for cold fusion of a toner to a medium utilizing a fusing agent according to claim 2, further comprising the step of selecting a substantially 100% hydrochlorofluorocarbon compound from which to form the vapor cloud.

8. The method for cold fusion of a toner to a medium utilizing a fusing agent according to claim 3, further comprising the step of selecting 1,1-dichloro-1-fluoroethane as the sole compound, excluding inert additives, from which to form the vapor cloud.

9. The method for cold fusion of a toner to a medium utilizing a fusing agent according to claim 4, further comprising the step of selecting 1,1-dichloro-1-fluoroethane as the sole compound, excluding inert additives, from which to form the vapor cloud.

* * * * *

UNITED STATES PATENT AND TRADEMARK OFFICE
Certificate

Patent No. 5,333,042 Patented: July 26, 1994

On motion pursuant to 37 C.F.R. § 1.634 in Interference No. 103,692, it has been found that the above-identified patent, through error and without any deceptive intention, incorrectly sets forth the inventorship.

Accordingly, pursuant to 35 U.S.C. § 256 it is hereby certified that the correct inventorship of this patent is: Michael W. Brennan.

Signed and Sealed this Ninth Day of May, 2000.

MARY F. DOWNEY,
*Administrative Patent Judge*
Board of Appeals and Interferences